US007490374B2

(12) United States Patent
Fugate et al.

(10) Patent No.: US 7,490,374 B2
(45) Date of Patent: Feb. 17, 2009

(54) SPA APPARATUS

(75) Inventors: Norman R. Fugate, Milwaukee, WI (US); Robert J. Miller, Waukesha, WI (US)

(73) Assignee: European Touch Holdings, Inc., Milwaukee, WI (US)

( * ) Notice: Subject to any disclaimer, the term of this patent is extended or adjusted under 35 U.S.C. 154(b) by 0 days.

(21) Appl. No.: 11/394,642

(22) Filed: Mar. 31, 2006

(65) Prior Publication Data

US 2007/0226896 A1 Oct. 4, 2007

(51) Int. Cl.
*A47K 3/022* (2006.01)

(52) U.S. Cl. ..... 4/622; 4/621; 4/574.1; 4/560.1

(58) Field of Classification Search ..... 4/621–622, 4/574.1, 560.1; 601/156–158; 297/301.1, 297/310, 451.1, 451.18, 423
See application file for complete search history.

(56) References Cited

U.S. PATENT DOCUMENTS

| | | | | |
|---|---|---|---|---|
| 2,061,142 | A | | 11/1936 | Denocenzo |
| 2,307,621 | A | * | 1/1943 | Dorton ..... 297/367 |
| 2,312,524 | A | | 3/1943 | Cox |
| 2,417,499 | A | | 3/1947 | Ille |
| 2,452,405 | A | * | 10/1948 | Vincent, Jr. ..... 297/359 |
| D160,368 | S | | 10/1950 | Centerbar |
| 2,733,711 | A | | 2/1956 | Gibson |
| 2,738,787 | A | | 3/1956 | Jacuzzi et al. |
| 3,159,849 | A | | 12/1964 | Jacuzzi |
| 3,273,560 | A | | 9/1966 | Jacuzzi |
| 3,287,741 | A | | 11/1966 | Nash |
| 3,297,025 | A | | 1/1967 | Jacuzzi |
| 3,760,800 | A | | 9/1973 | Staffin et al. |
| 3,832,740 | A | | 9/1974 | McClarrin |
| 3,924,278 | A | | 12/1975 | Ekman |
| 3,940,807 | A | | 3/1976 | Baker et al. |
| 3,964,471 | A | | 6/1976 | Saethre |
| 3,965,495 | A | | 6/1976 | McNair |
| 4,004,302 | A | | 1/1977 | Hori |
| 4,100,917 | A | | 7/1978 | Talge et al. |
| 4,115,878 | A | | 9/1978 | Johnson et al. |

(Continued)

FOREIGN PATENT DOCUMENTS

| | | |
|---|---|---|
| JP | 6-46964 | 2/1994 |

(Continued)

OTHER PUBLICATIONS

Golden Ratio Woodworks—The Grand Versailles, available at http://www.goldenratio.com/GRW/Spa/GrandVersailles.html, © 2005 Golden Ratio, All Rights Reserves (1 p.).

(Continued)

*Primary Examiner*—Khoa D Huynh
(74) *Attorney, Agent, or Firm*—Foley & Lardner LLP

(57) ABSTRACT

A spa apparatus includes an internal support structure having a front end and a rear end; a basin removably coupled and supported by the internal support structure proximate the front end, with the basin including a fluid circulation device; a seat coupled to the internal support structure, intermediate the basin and the rear end of the internal support structure; and at least a first and second shroud panel removably coupled to the internal support structure and configured to enclose a portion of the internal support structure.

31 Claims, 9 Drawing Sheets

U.S. PATENT DOCUMENTS

| | | | |
|---|---|---|---|
| 4,168,705 | A | 9/1979 | Raab |
| 4,184,488 | A | 1/1980 | Bielich |
| 4,330,412 | A | 5/1982 | Frederick |
| 4,349,434 | A | 9/1982 | Jaworski |
| 4,420,846 | A | 12/1983 | Bonner |
| 4,485,503 | A | 12/1984 | Rolando et al. |
| 4,520,525 | A | 6/1985 | Yogi et al. |
| 4,525,881 | A | 7/1985 | Higginbotham |
| D288,037 | S | 2/1987 | Orenstein |
| 4,665,572 | A | 5/1987 | Davidson et al. |
| 4,742,584 | A | 5/1988 | Abe |
| 4,853,987 | A | 8/1989 | Jaworski |
| 4,903,352 | A | 2/1990 | Murakami |
| 4,984,583 | A | 1/1991 | Peterson et al. |
| 5,044,357 | A | 9/1991 | Johns |
| 5,083,329 | A | 1/1992 | Murakami |
| D342,165 | S | 12/1993 | Marshall et al. |
| 5,414,878 | A | 5/1995 | Booth |
| D363,168 | S | 10/1995 | Lewis |
| D372,843 | S | 8/1996 | Trent et al. |
| 5,587,023 | A | 12/1996 | Booth |
| 5,588,161 | A | 12/1996 | Barradas |
| 5,729,841 | A | 3/1998 | Chan |
| 5,816,659 | A | 10/1998 | Wolf |
| D403,515 | S | 1/1999 | Lewis |
| 6,003,166 | A | 12/1999 | Hald et al. |
| D421,853 | S | 3/2000 | Black |
| D429,379 | S | 8/2000 | Kim |
| D434,916 | S | 12/2000 | Galati, Jr. et al. |
| D435,937 | S | 1/2001 | Back et al. |
| 6,357,059 | B1 | 3/2002 | Lau |
| D455,017 | S | 4/2002 | Tran |
| D455,566 | S | 4/2002 | Park |
| D456,154 | S | 4/2002 | Huynh et al. |
| 6,363,548 | B1 | 4/2002 | Kuo |
| 6,393,633 | B2 | 5/2002 | Ferber |
| 6,405,390 | B2 | 6/2002 | Kuen |
| 6,438,768 | B1 | 8/2002 | Yen |
| 6,503,212 | B2 | 1/2003 | Park |
| 6,565,522 | B1 | 5/2003 | Chen |
| 6,598,244 | B1 | 7/2003 | Yeh |
| D479,919 | S | 9/2003 | Genelli et al. |
| 6,659,112 | B1 | 12/2003 | Haupt |
| D487,533 | S | 3/2004 | Abbott et al. |
| D489,140 | S | 4/2004 | Froech |
| 6,790,188 | B2 | 9/2004 | Chen |
| 6,805,678 | B2 | 10/2004 | Cafaro |
| 6,880,182 | B2 | 4/2005 | Gruenwald |
| 6,916,297 | B2 | 7/2005 | Hafemann |
| 6,923,206 | B2 | 8/2005 | Glover et al. |
| 6,973,683 | B2 | 12/2005 | Lev et al. |
| 6,979,300 | B1 | 12/2005 | Julian et al. |
| D518,182 | S | 3/2006 | Cafaro et al. |
| 7,028,362 | B2 | 4/2006 | Davallou |
| 7,065,808 | B2 | 6/2006 | Leung et al. |
| 2004/0177438 | A1* | 9/2004 | Gruenwald et al. ..... 4/560.1 |
| 2004/0216225 | A1 | 11/2004 | Booth et al. |
| 2005/0132487 | A1* | 6/2005 | Layfield et al. ..... 4/541.1 |
| 2007/0226896 | A1 | 10/2007 | Fugate et al. |

FOREIGN PATENT DOCUMENTS

| | | |
|---|---|---|
| JP | 6-78858 | 3/1994 |
| JP | 6-339509 | 12/1994 |

OTHER PUBLICATIONS

SpaEquip: La Fleur Pedicure Chair from Gulfstream, available at http://www.spaequip.com/store/GSLF.jsp, © 2000-2004 SpaEquip, All Rights Reserved (1 p.).

* cited by examiner

FIG. 3
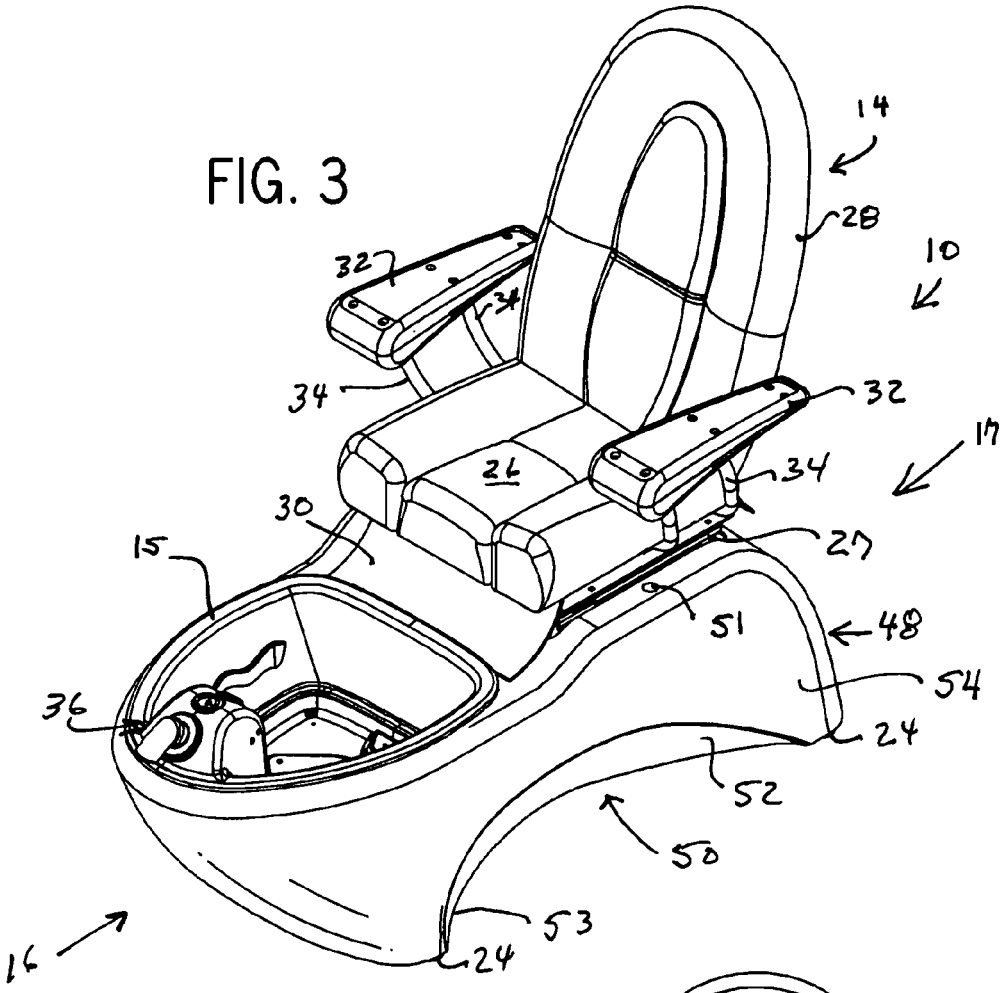
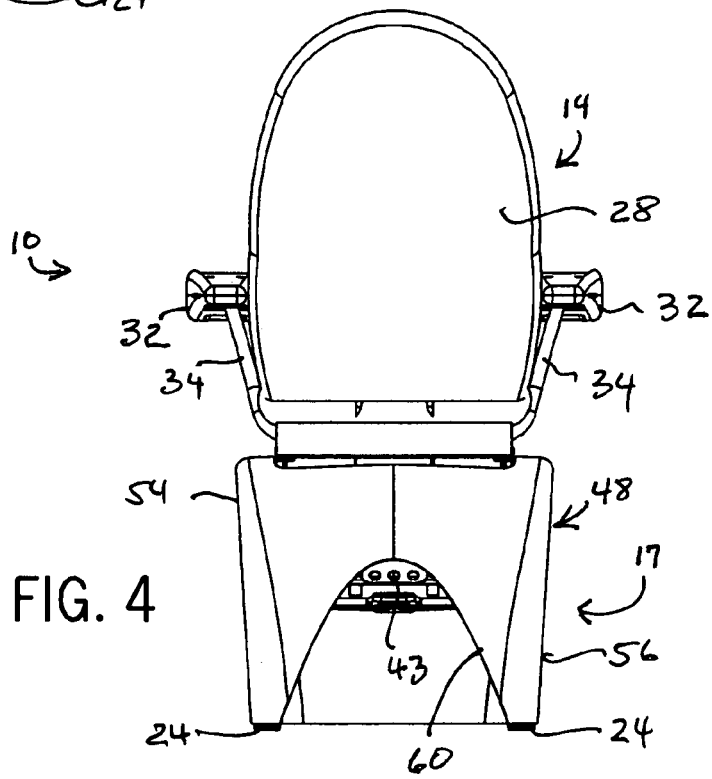
FIG. 4

SPA APPARATUS

FIELD OF THE INVENTION

The present invention relates generally to the field of spas and particularly to a reconfigurable spa.

BACKGROUND OF THE INVENTION

Spas are well known for use in facilitating comfort and relaxation. Pedicure spas specifically allow for treatment and comfort of the feet of a person in addition to other incorporated services. Pedicure spas do not always efficiently allow a spa professional to attend to a client due to the awkward construction of the unit. Pedicure spas can also be difficult to get into when armrests are in the way. Access to the electrical and plumbing components of prior art spas is difficult because of one piece internal support structures. Further, pedicure spa seats can become stylistically outdated or worn with repeated use necessitating replacement of the entire seat or spa.

Thus there is a need for a pedicure spa construction that facilitates a spa professional in being as close as possible to the client. There is also a need for a spa that includes a support structure to support a seat, basin and a removable shroud enclosing at least a portion of the support structure. There is also a need for a spa construction that provides easy entry and exit for the client. There is also a need for a water pump configuration in a pedicure spa that facilitates access to components for service or replacement. There is also a need for a replaceable seat cover for a pedicure spa.

SUMMARY OF THE INVENTION

One embodiment of the invention relates to a spa apparatus. The spa apparatus includes an internal support structure having a front end and a rear end. The spa apparatus further includes a basin removably coupled and supported by the internal support structure proximate the front end, with the basin including a fluid circulation device. The spa apparatus further includes a seat coupled to the internal support structure, intermediate the basin and the rear end of the internal support structure. The spa apparatus further includes at least a first and second shroud panel removably coupled to the internal support structure and configured to enclose a portion of the internal support structure.

Another embodiment of the invention relates to an internal support structure for a spa that includes a fluid retaining basin and a seat. The internal support structure includes a first support member, including two legs; a second support member, including two legs; at least one cross member coupled to each support member and configured to maintain the support members in a spaced apart relationship; a first shroud panel removably coupled to the first support member; and a second shroud panel removably coupled to the second support member. The first and second shroud panels enclose a portion of each of the support members Another embodiment of the invention relates to a spa apparatus. The spa apparatus includes an internal support structure having a front end and a rear end. The spa apparatus further includes a basin removably coupled and supported by the internal support structure proximate the front end, with the basin including a fluid circulation device. The spa apparatus further includes a seat coupled to the internal support structure, intermediate the basin and the rear end of the internal support structure. The spa further includes a means for enclosing removably coupled to the internal support structure, wherein a portion of the internal support structure is enclosed.

BRIEF DESCRIPTION OF THE DRAWINGS

FIG. 3 is a front perspective view of a spa apparatus with a shroud removably coupled to and supported by the internal support structure according to one example embodiment.

FIG. 4 is a rear view of the spa of FIG. 3 according to one example embodiment.

DETAILED DESCRIPTION OF THE EXAMPLE EMBODIMENTS

Figure 1:
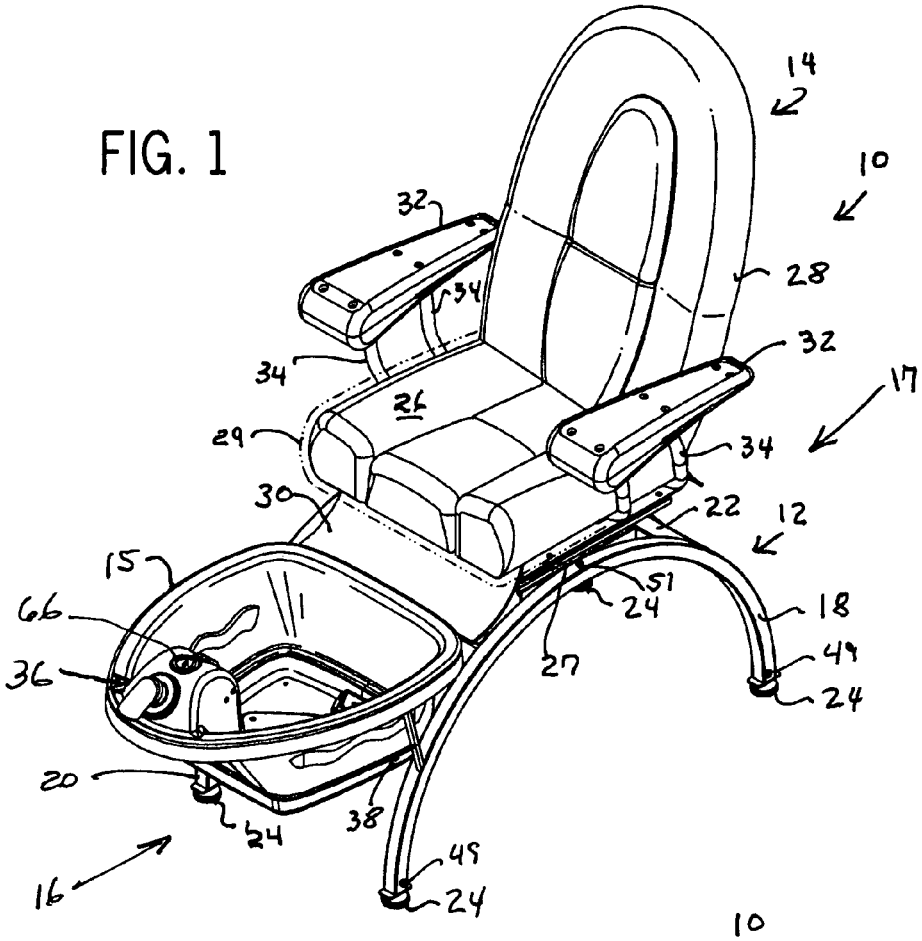
FIG. 1 is a front perspective view of a spa apparatus according to one example embodiment including an internal support structure with arched members.

Referring to FIG. 1, spa 10 is intended to seat a person in order to facilitate services to that person. In one example embodiment, the person may receive a pedicure and spa 10 may be a pedicure spa. In other example embodiments, the person may receive other services such as a manicure or haircut. Spa 10 generally includes a internal support structure 12, a seat 14, and a basin 15.

Internal support structure 12, also known as a base, supports the structure of seat 14 and basin 15 and is intended to provide a person with easy access to spa 10 and the feet and legs of someone sitting in seat 14. Internal support structure 12 is configured to support spa 10 while providing easy access to the underside of spa 10 for repairs or cleaning and to allow for someone providing services to a person seated in spa 10 to slide close with their feet underneath internal support structure 12 at either side, the front, or rear of internal support structure 12.

Internal support structure 12 may be defined as having a front end 16 and a rear end 17 and generally includes a first member 18, a second member 20, a cross-member 22, and a footpad 24. First and second members 18 and 20 are of a curved shape and each defines two legs that extend towards the surface that spa 10 rests on. One or more cross-members 22 couple with members 18 and 20 to provide support for spa 10 and the weight of someone sitting thereon. Each footpad 24 is coupled to the legs of members 18 and 20 to provide contact points with the surface spa 10 rests on and is intended to reduce the chance of damaging the floor and to prevent spa 10 from sliding. In various example embodiments, members 18 and 20, cross-member 22, and footpad 24 each may be composed of any metal (e.g. steel, iron, aluminum, titanium), polymer (e.g., plastic, rubber), or any other suitable material or combination thereof. In another example embodiment, footpads 24 may be wheels or casters that function to move spa 10. In still another example embodiment, footpads 24 may be adjustable in order to vary the height of spa 10 or to level spa 10 if resting on an uneven surface.

Seat 14 is intermediate basin 15 and rear end 17 of internal support structure 12 and is intended to provide a comfortable surface and sitting position for a person receiving services on spa 10. Seat 14 generally includes a cushion 26, a seatback 28, a splashguard 30, and an armrest 32. Cushion 26 provides an ergonomic surface for a person to sit on and is surrounded by a skin or covering. Cushion 26 may contain any desired amount of a material known in the art to provide cushioning for a person seated on it. In one example embodiment, cushion 26 may be heated. In another example embodiment, the skin of cushion 26 may be removable for various reasons such as to facilitate reconditioning or replacement while in still another example embodiment, the skin of cushion 26 may be permanently attached to the interior portion of cushion 26. In various other example embodiments, the skin of cushion 26 may be composed of any past, present, or future material used as a seat cover such as cloth, leather, or vinyl.

Seatback 28 provides an ergonomic surface to support the torso of a person sitting on cushion 26. Seatback 28 may contain any desired amount of a material known in the art to provide cushioning for a person leaning on it and is surrounded by a skin or covering. In other example embodiments, seatback 28 may include a massage function. In these example embodiments that include a massage function, one or more various types of massage mechanisms such as a massage roller and vibration massage mechanism may be used. In other example embodiments, seatback 28 may include a neck pillow to support the head and neck of a person sitting in seat 14. In another example embodiment, the skin of seatback 28 may be removable for various reasons such as to facilitate reconditioning or replacement while in still another example embodiment, the skin of seatback 28 may be permanently attached to the interior portion of cushion 26. In various other example embodiments, the skin of seatback 28 may be composed of any past, present, or future material used as a seat cover such as cloth, leather, or vinyl.

Splashguard 30 is intended to reduce the amount of splash from basin 15 that gets under seat 14. In various example embodiments a splash guard may be implemented in the front of seat 14, either side of seat 14, the rear of seat 14, or any combination thereof. Splashguard 30 may be composed of any material that at least to some degree prevents water or other substance that may be in basin 15 from passing through. In some example embodiments splashguard 30 may be attached to cushion 26 or seatback 28 via a hook and loop fastener, another fastener, or by sewn thread, while in other example embodiments splashguard 30 may not be attached but retained by the weight of cushion 26 or seatback 28.

Armrest 32 is generally configured to support the arms of a person seated in seat 14. In various example embodiments, one or more armrests may be attached to either internal support structure 12 or seat 14. While the illustrated example embodiment shows armrest 32 attached to spa 10 via two support bars 34, in other example embodiments more or fewer than two support bars could be used to retain armrest 32 and support the weight of the arms of a person or support bars 34 may be omitted altogether with armrest 32 attached to spa 10 via some other means. In various example embodiments, armrest 32 may be made of any suitable material such as metal or plastic and may include a cushioned top surface or a hard top surface.

Basin 15 is proximate to front end 16 of internal support structure 12 and is configured to provide a person seated in seat 14 with a foot massage via water pushed through a jet, for example a fluid massage device. Basin 15 generally includes a drain activator 67 for releasing water from basin 15. In one example embodiment, basin 15 may be streamlined for convenient access by a person to the feet and legs of someone seated in seat 14. In another example embodiment basin 15 may be made of an acrylic basin with an acrylonitrile-butadiene-styrene (ABS) backing or interior while in other embodiments, a different backing may be used such as fiberglass. In another exemplary embodiment, basin 15 may be a composed of a material that is different from the material composing internal support structure 12. In still other example embodiments the basin may be composed of a different material than acrylic such as another plastic, a metal, a combination of plastic and metal, or glass.

Figure 2:
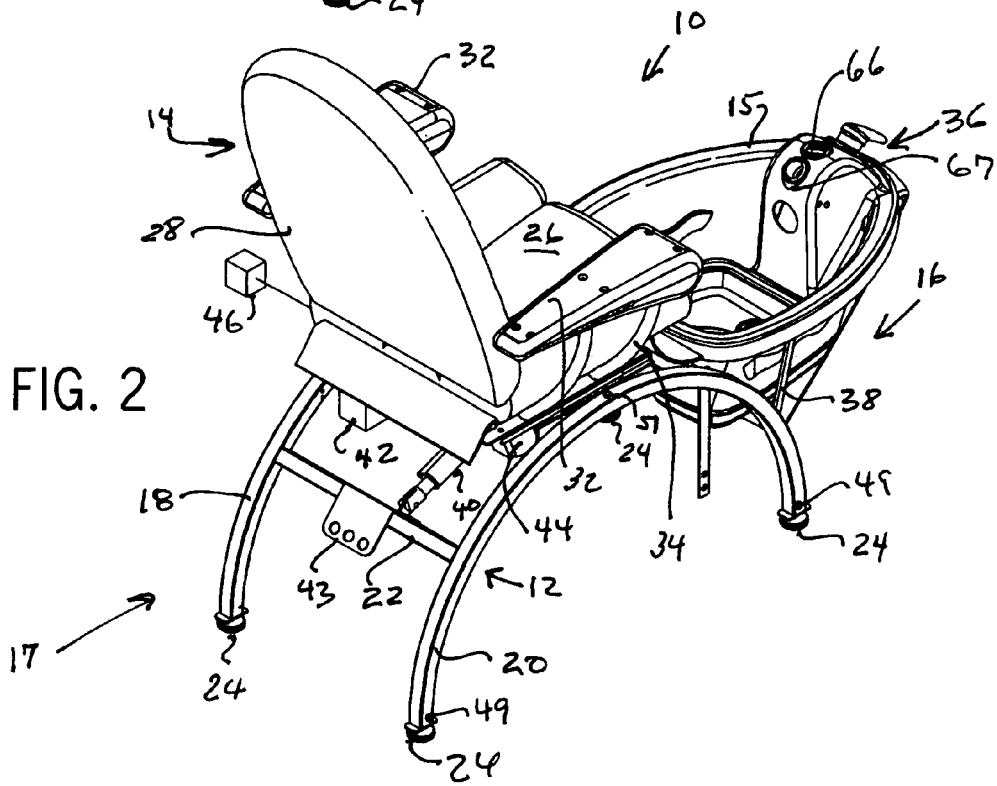
FIG. 2 is a rear perspective view of the spa apparatus of FIG. 1 according to one example embodiment.

Referring to FIG. 2, internal support structure 12 is show to facilitate the support of basin 15 as well as the plumbing 40 and electrical lines 42 of spa 10. A basin support 38 is coupled to members 18 and 20 and may extend around at least a portion of the underside of basin 15. In other example embodiments basin supports may alternatively run under the bottom of basin 15 rather than around the rim. Water lines 40 may run down the opposite side of electrical lines 42, so that in the event of a water leak the possibility of a short is reduced. Water lines 40 and electrical lines 42 may enter and exit spa 10 via a centralized and convenient access point 43, for example at rear end 17 of internal support structure 12. Splashguard 30 is intended to also prevent water that may come from a leak in water lines 40 from getting under seat 14.

Pump 44 is configured to aid in the expulsion of water from basin 15 when drain activator 67 is operated. Drain activator 67 includes a drain overflow and sensor to activate the drain pump 44. Pump 44 may expel water through water lines 40 and into a drain line via access point 42. In one example embodiment pump 44 may be automatically started by magnetic sensors when drain activator 67 opens the drain. Pump 44 is suspended above the floor via an attachment to internal support structure 12 or seat 14 in order to aid in the expulsion of water from spa 10 and to allow for additional room under spa 10. In one example embodiment pump 44 may retain only the amount of water necessary for priming. In various example embodiments, pump 44 may be any suitable pump of past, present, or future design that is able to be suspended.

Controller 46 is configured to electrically control adjustments to the position of seatback 28, a massage or vibration function of seat 14, water-flow in basin 15, or any combination thereof. While the illustrated example embodiment shows controller 46 to be hardwired to spa 10, in other example embodiments controller 46 may be an integral body within a portion of spa 10, such as armrest 32 or cushion 26, or a wireless controller. In an example embodiment where controller 46 is not an integral body with a portion of spa 10, cushion 26, seatback 28, or armrest 32 may include a pocket that holds controller 46 when not in use.

Figure 7:
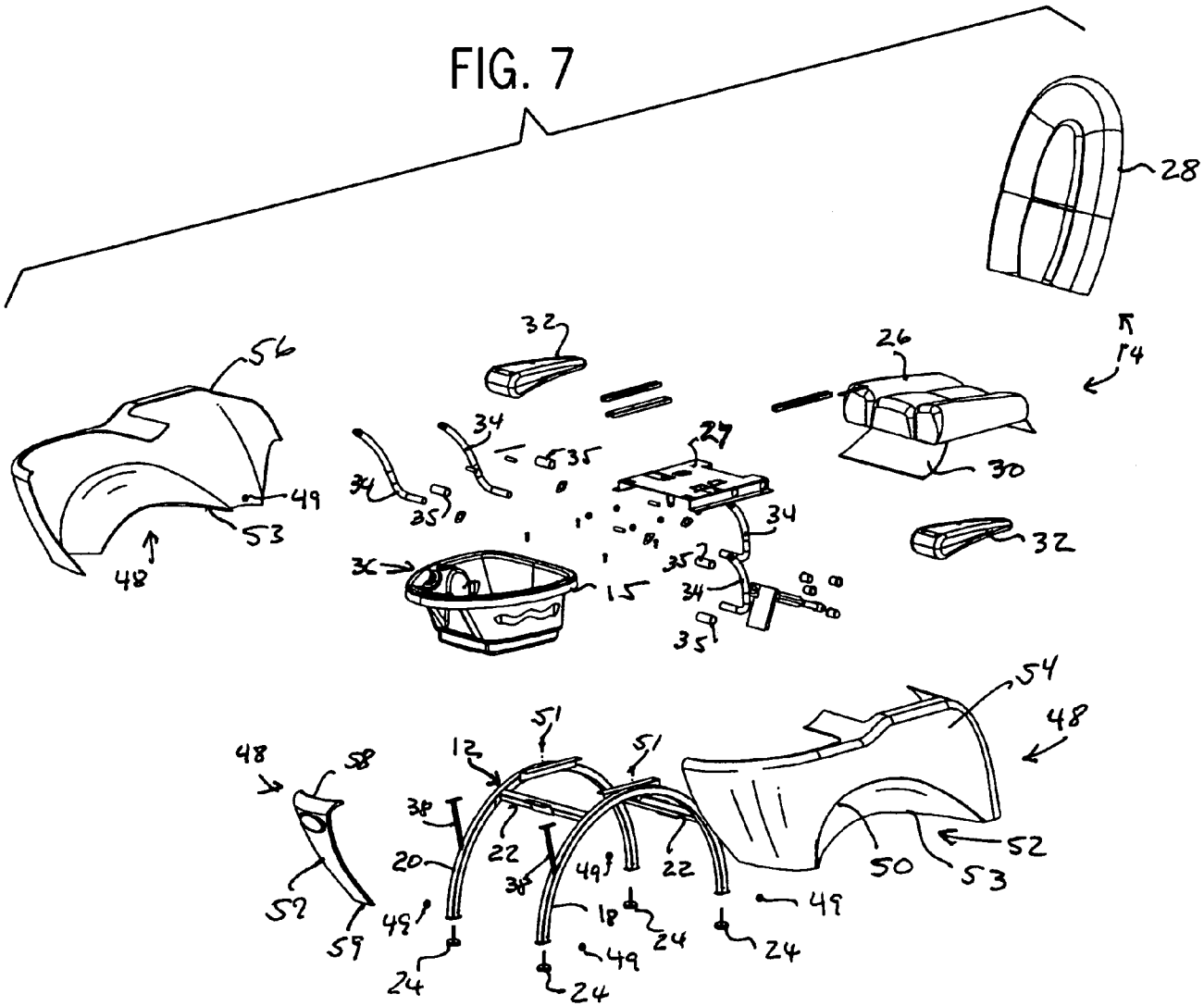
FIG. 7 is a perspective exploded view of the spa apparatus of FIG. 3 according to one example embodiment.

Referring to FIG. 3, internal support structure 12 is substantially enclosed within a multi-panel shroud 48 for aesthetic purposes while still providing a person with easy access to spa 10 and the feet and legs of someone sitting in seat 14. Shroud 48 generally defines an arched channel 50 and an indentation 52 that is proximate to a lower edge 53 of each of a first panel 54 and a second panel 56. A third panel 57 serves to couple panels 54 and 56 at the front of basin 15 and has an upper edge 58 that is proximate or adjacent to basin 15 and a lower edge 59 that extends under a portion of basin 15. Third panel 57 slopes inward and downward providing a region for the feet of a technician as the technician attends to a user if the spa. Channel 50 and indentation 52 allow the feet of the person to slide underneath spa 10 while conforming with the legs of the person when seated in a chair or stool. Additionally, a person may slide close to the front of spa 10 with their feet under the front of basin 15 and near lower edge 59 of panel 57, for example to provide access to the feet of a person sitting in seat 14. Panels 54, 56, and 57 are coupled to internal support structure 12 and each other and do not support any weight, but are coupled to internal support structure 12 for a more aesthetically pleasing design. In one example embodiment panels 54 and 56 may be coupled via one or more thumb screws and panel 57 by one or more magnets to allow for quick removal for greater access to the underside of spa 10 for tasks such as repairs or cleaning or in order to change the color or style. In other example embodiments, panels 54 and 56 may be attached by one or more magnets and panel 57 by one or more thumb screws or panels 54, 56, and 57 may be attached with other types of fasteners, such as bolts or clips. In still other example embodiments panels 54, 56, and 57 may be permanently attached to spa 10. In various example embodiments panels 54, 56, and 57 may be composed of a plastic, fiberglass, metal, other suitable material, or any combination thereof. In alternative embodiments, the number of panels may be reduced to two or more than three. Referring to FIGS. 1, 2 and 7 in one embodiment each of the first and second panels 54, 56 is secured with a pair of magnets 49 coupled to the legs of the support members 18, 20 of the internal support structure 12 and a thumb screw 51 located on a top portion of the internal support structure 12.

Referring to FIG. 4, shroud 48 further defines an arched opening 60 in the rear of spa 10 for greater access to the underside of spa 10 for various tasks including cleaning, repairs, or installation without having to remove panel 54 and/or 56. Access point 43 is not concealed and still provides a convenient hook-up for water lines 40 and electrical lines 42. In other example embodiments, opening 60 may be larger or smaller to provide access to a greater or narrower scope of items on the underside of spa 10 or may be omitted altogether with access being provided when panels 54 and 56 are removed. In another example embodiment, opening 60 may be provided with a door or similar enclosure.

Figure 5:
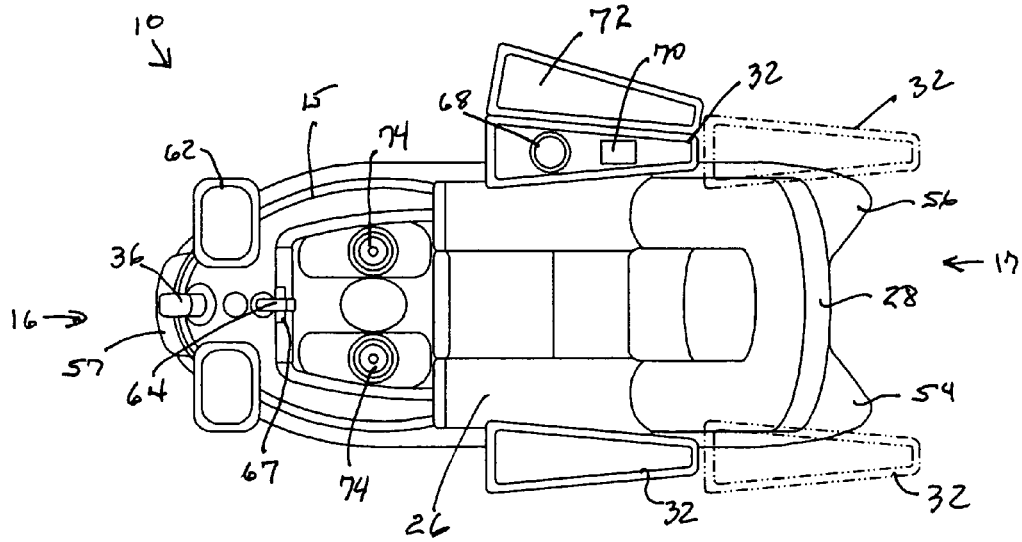
FIG. 5 is a top schematic view of a spa apparatus according to one example embodiment.
Figure 8B:
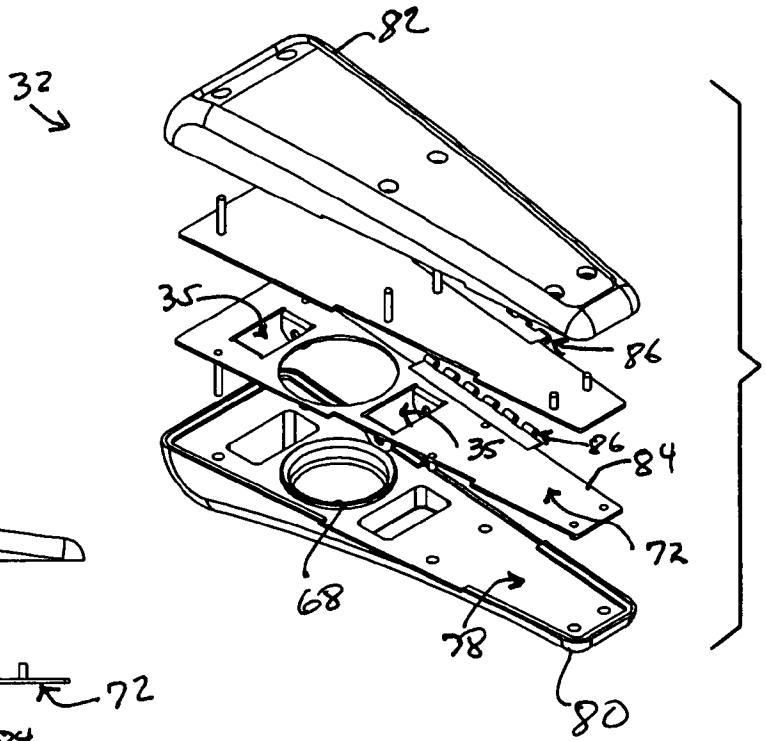
FIG. 8B is a perspective view of the armrest illustrated in FIG. 8A.
Figure 8A:
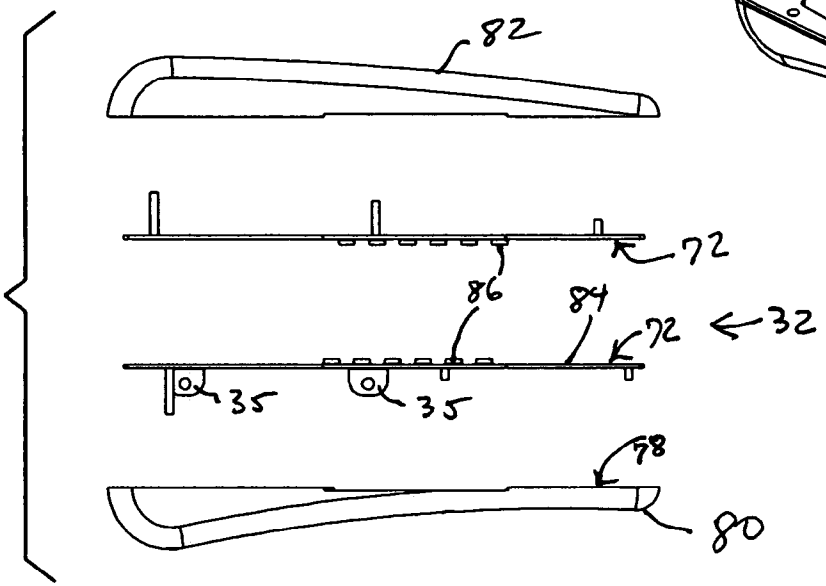
FIG. 8A is a side plan view of an example embodiment of an armrest including an insert member and a cover.
Figure 9:
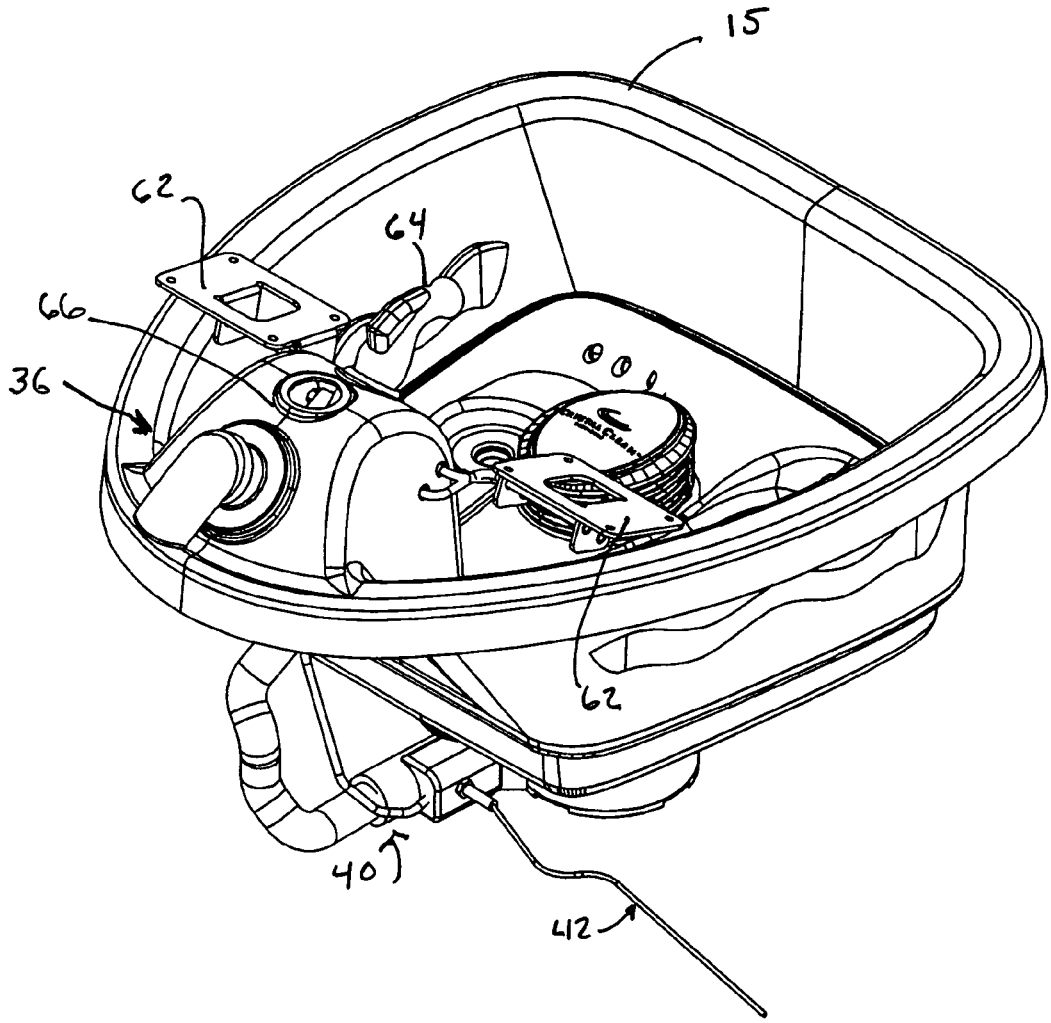
FIG. 9 is a perspective view of an exemplary embodiment of a removable basin for a spa apparatus.
Figure 12:
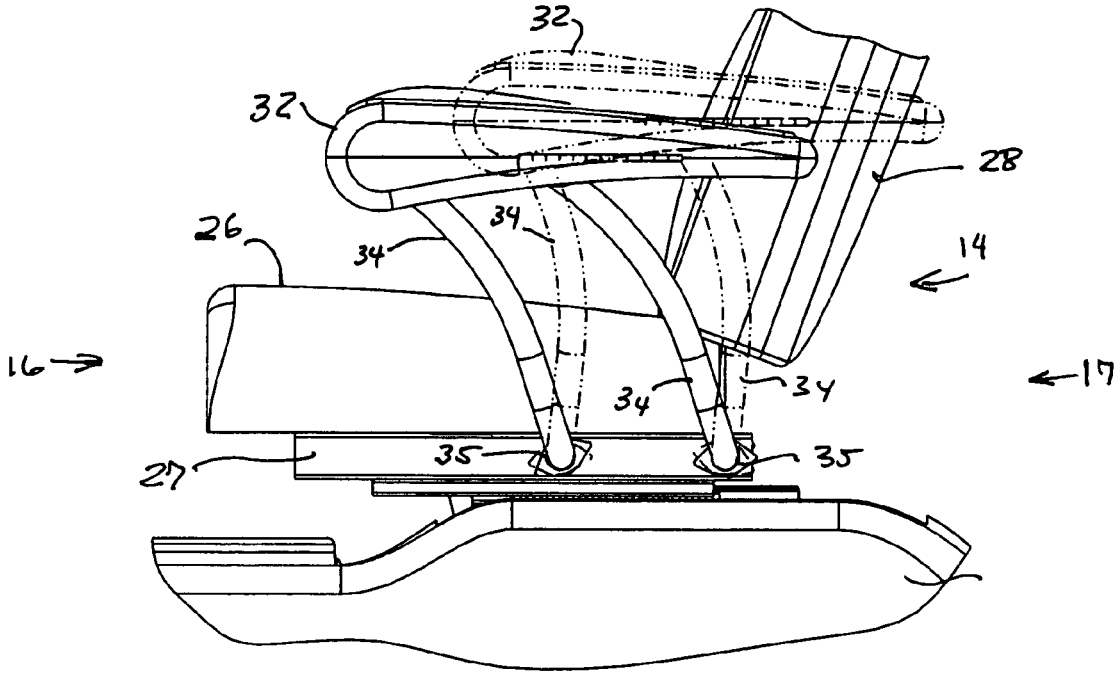
FIG. 12 is a partial side view of an exemplary embodiment of a seat for a spa apparatus, with an armrest in a first position (solid line) and in a second position (broken lines), with the armrest maintained in a horizontal aspect relative to the support structure.

Referring to FIGS. 5 and 8, armrest 32 is configured to move in a forward or backward direction, relative to internal support structure 12, independent of the position of seatback 28. When armrest 32 slides back, it may be easier for a person to get onto or out of spa 10. Armrest 32 moves from a first forward in use position to a second rearward non-use position in which the armrest 32 is located away form the front of the seat 14. The armrest 32 moves independently of the seat 14. This allows both easy access to get in and out of the seat as well as to provide a wider comfortable seat for larger users. As described below armrest 32 moves from the first to the second positions while remaining substantially horizontal relative to the internal support structure 12. While the armrest 32 moves in an arcuate path (see FIGS. 6 & 12), the top portion of the armrest remains horizontal. In the preferred embodiment, this movement is accomplished by multiple pivots 35. Referring to FIGS. 8A and 12, armrest 32 includes two support members 34. Each support member 34 is secured to the seat track plate 27 coupled to the internal support structure 12 and armrest 32 with a lower and upper pivot 35.

In other example embodiments, armrest 32 may rotate rather than slide or may not move at all. Armrest 32 is further configured to flip open and define a compartment which includes a fluid container holder 68, for example a beverage holder; a fluid pan 70, for example a hand or manicure soaker; and a work area 72. In another exemplary embodiment, armrest 32 defines a compartment or hollow shell 78 between a base structure 80 and cover 82, as shown in FIG. 8, configured to retain an insert 84 that defines one or more of holder 68, pan 70, and area 72. In still another exemplary embodiment, hollow shell may be substantially defined by cover 82 to retain insert 84 when cover 82 is flipped open. In other exemplary embodiment, In other example embodiments, armrest may contain any combination of holder 68, pan 70, and area 72, or none at all.

Spa 10 further includes a footrest 62, sprayer/faucet 64, and controls 66. Footrests 62 may be supported by the perimeter of basin 15 and are intended to support the foot of a person sitting in seat 14 when the foot is not in basin 15 itself. In various example embodiments, one or more footrests 62 may be employed in an adjustable manner as desired to accommodate various leg lengths of someone sitting in seat 14. In other example embodiments, footrests 62 may be made of any material such as plastic or metal and the top of footrests 62 may be cushioned or substantially hard. In still other example embodiments footrests 62 may be attached to basin via a fastener, such as a screw or bolt; via a shape configured to mate with the shape of basin 15; or via any other means such as an adhesive.

Faucet assembly 36 may be used to fill basin 15 or spray water on the feet of someone sitting in seat 14. In one example embodiment, faucet assembly 36 is a pull-out sprayer that can be sprayed in a number of different directions. In various example embodiments faucet assembly 36 may be made of any suitable material such as metal or thermoplastic. Faucet assembly 36 includes two fill spouts that hook directly into the faucet and the configuration of the fill spout.

Controls 66 are configured to control various functions of spa 10. In various example embodiments, controls 66 may include control means for water temperature or turning on a fluid circulation device 74 for massaging the feet of a person sitting in spa 10. In such an example embodiment, controls 66 may be in a relatively close proximity to faucet assembly 36 on a center console configuration so that drain, faucet, temperature, and water massage or mechanical foot massage functions may all be accessed quickly and easily. In other example embodiments, more or fewer than the above functions and controls may be included. In another example embodiment, the water from massage device 74 may be propelled by an impeller actuated by water and in fluid communication with basin 15.

Figure 6:
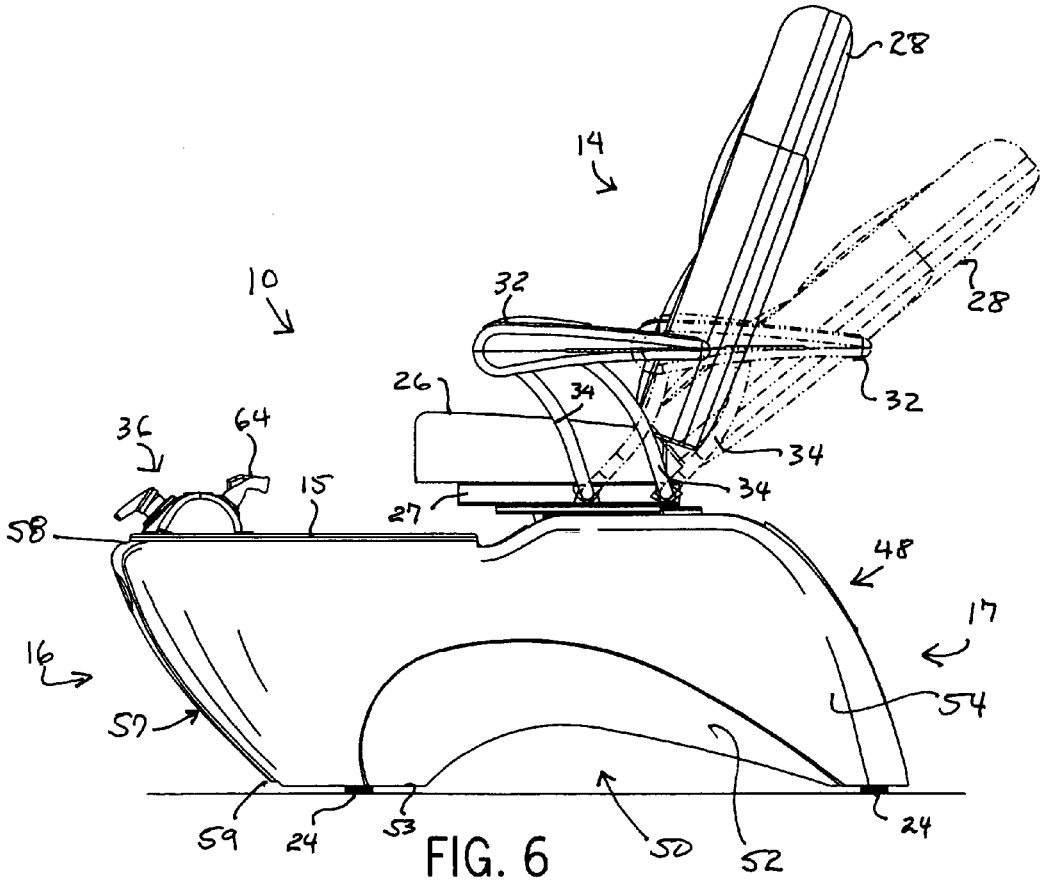
FIG. 6 is a side schematic view of a spa apparatus according to one example embodiment, illustrating the seatback and armrest in a forward position and the seatback and armrest in a backward position (broken lines), with the armrest maintained in a horizontal aspect relative to the support structure.

Referring to FIGS. 6 and 12, seatback 28, armrest 32, and cushion 26 may be moved in a forward or backward direction into at least a first position and a second position. Seatback 28 may move, for example, to upright, reclined and foldover positions. While armrest 32, seatback 28, and cushion 26 may both move to multiple positions, it is noted that armrest 32, seatback 28, and cushion 26 move independently of each other. The positioning of seatback 28 can be done electrically via an actuator 76 that is coupled to seat 14 and internal support structure 12 using controller 46 or other control means that communicate with spa 10. In one example embodiment, actuator 76 may be an electric motor. In another example embodiment, seatback 28 may be positioned manually. In still another exemplary embodiment, when armrest 32 moves forward or backward, support 34 moves on a hinge 86 (FIGS. 9-12); which may also be a pivot point or swivel. In other example embodiments, armrest 32, seatback 28, and/or cushion 26 may move in a unitary fashion. In still other example embodiments, armrest 32, seatback 28, and cushion 26 may move between any number of positions.

When armrest 32, seatback 28, or cushion 26 move in a forward direction they move towards front end 16 and when they move in a backward direction they move towards rear end 17. Upper edge 58 is proximate to basin 15 and lower edge 59 positioned under a portion of basin 15, as can now be more clearly seen. This allows for someone to get close to the front of the spa with their feet fitting under basin 15 at lower edge 59.

Referring to FIG. 7, seat 14, basin 15, and panels 54, 56, and 57 are removable from internal support structure or support structure 12 in one example embodiment of spa 10. Seat 14 may be removed from internal support structure 12 for many functional or stylistic reasons including replacement with another seat, reconditioning, or changing of a seat cover 29. Referring to FIG. 6, seat 14 is removalby coupled to the internal support structure 12. In one embodiment, seat 14 is coupled to a seat track 25 which is coupled to the internal support structure 12. Basin 15 may be removed from internal support structure 12 for various reasons including cleaning and replacement of another type of basin. Panels 54, 56, and 57 may be removed for replacement such as to change colors or styles. Internal support structure 12 supports the full weight of each of seat 14, basin 15, and panels 54, 56, and 57 and thus each may be removed or replaced as necessary and desired.

Although spa 10 is illustrated as including multiple features utilized in conjunction with one another, spa 10 may alternatively utilize less than all of the noted mechanisms or features. For example, in other exemplary embodiments, footrest 62 may be omitted. In still other embodiments, more or fewer than the illustrated number of support bars 34 may be used.

Figure 10:
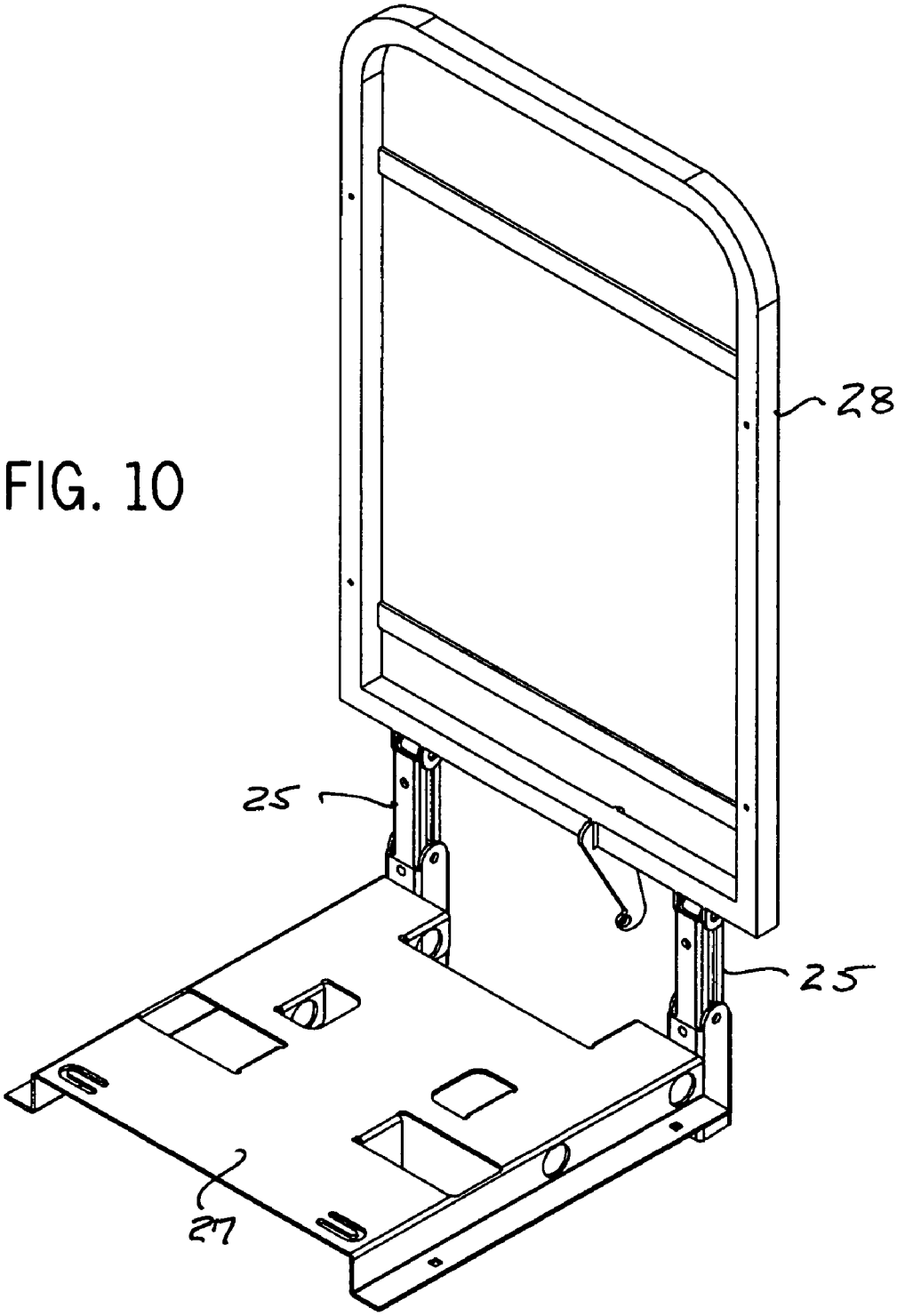
FIG. 10 is a perspective schematic view of an exemplary embodiment of a seat mechanism for a spa apparatus, without the seatback and seat cushion upholstery.
Figure 11A:
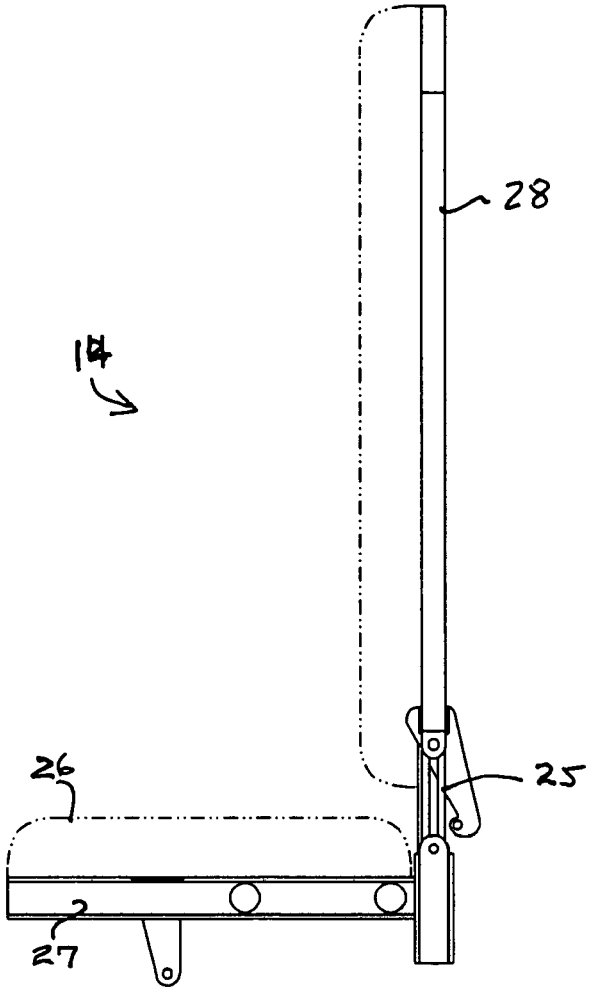
FIG. 11A is a partial side view of the seat mechanism illustrated in FIG. 10, with the seatback raised prior to a fold over movement.
Figure 11B:
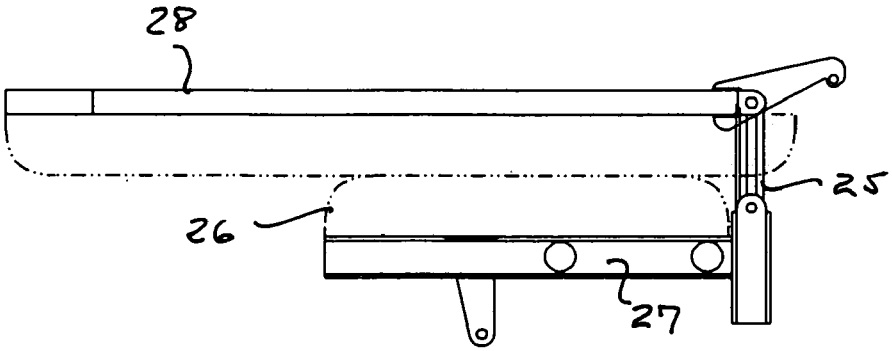
FIG. 11B is a partial side view of the seat mechanism illustrated in FIG. 10, with the seatback folded over the seat cushion for shipping.

Referring to FIGS. 10, 11A and 11B, a method for attaching the seatback 28 to the seat track plate 27 with a pair of seat tracks 25 to enable the seatback 28 to be laid flat on the seat cushion 26 for shipping and to allow easy installation and removal of the seat 14 by simply removing two pins for servicing. To assemble the seatback 28 from its shipping container a user simply rotates the seatback 28 from the flat position to an upright position, lowers the seatback 28 along the seat track 25 and engages the two pins to secure the seatback 28 in a use position. Other convenient means for facilitating the movement of the seatback 28 to the shipping position can be used without deviating from this procedure.

Although specific shapes of each element have been set forth in the drawings, each element may be of any other shape that facilitates the function to be performed by that element. For example, channel 50 is shown to have a curved arch shape, however, in other embodiments channel 50 may be of a more triangular shape.

For purposes of this disclosure, the term "coupled" means the joining of two components (electrical or mechanical) directly or indirectly to one another. Such joining may be stationary in nature or movable in nature. Such joining may be achieved with the two components (electrical or mechanical) and any additional intermediate members being integrally defined as a single unitary body with one another or with the two components or the two components and any additional member being attached to one another. Such joining may be permanent in nature or alternatively may be removable or releasable in nature The present disclosure has been described with reference to example embodiments, however workers skilled in the art will recognize that changes may be made in form and detail without departing from the spirit and scope of the invention. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example is manifestly intended to be as broad as possible. For example, unless specifically otherwise noted a single particular element may also encompass a plurality of such particular elements.

It is also important to note that the construction and arrangement of the elements of the system as shown in the preferred and other exemplary embodiments is illustrative only. Although only a certain number of embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the assemblies may be reversed or otherwise varied, the length or width of the structures and/or members or connectors or other elements of the system may be varied, the nature or number of adjustment or attachment positions provided between the elements may be varied. It should be noted that the elements and/or assemblies of the system may be constructed from any of a wide variety of materials that provide sufficient strength or durability. Accordingly, all such modifications are intended to be included within the scope of the present disclosure. Other substitutions, modifications, changes and omissions may be made in the design, operating conditions and arrangement of the preferred and other exemplary embodiments without departing from the spirit of the present subject matter.

What is claimed is:

1. A spa apparatus comprising:

an internal support structure having a front end and a rear end wherein the internal support structure comprises a first arched member and a second arched member, each arched member defining two legs, with the first arched member and the second arched member maintained in a spaced apart relationship by a plurality of cross-members, and with the support structure substantially free of cross-members extending in a direction perpendicular to the plurality of cross-members;

a basin removably coupled and supported by the internal support structure proximate the front end, with the basin including a fluid circulation device;

a seat coupled to the internal support structure, intermediate the basin and the rear end of the internal support structure; and at least a first and second shroud panel removably coupled to the internal support structure and configured to enclose a portion of the internal support structure.

2. The spa of claim 1, including a third shroud panel, with the third shroud panel coupled to the first and second shroud panels.

3. The spa of claim 2, wherein the first and second shroud panels each define an arched channel proximate a lower edge of each panel.

4. The spa of claim 1, wherein each leg includes an adjustable foot pad.

5. The spa of claim 1, wherein the first and second arched members are each configured to engage and support the respective first and second shroud panels.

6. The spa of claim 1, wherein each arched member is composed of one of a material selected from a group consisting of metal, plastic, and a combination of metal and plastic.

7. The spa of claim 1, wherein the internal support structure is composed of metal.

8. The spa of claim 7, wherein the basin is composed of a material other than metal.

9. The spa of claim 1, wherein the basin is removable from the internal support structure.

10. The spa of claim 1, wherein at least one magnet couples each shroud panel to each internal support structure.

11. The spa of claim 1, wherein electrical components and plumbing components associated with the spa are supported and secured to the internal support structure.

12. The spa of clam 11, wherein the electrical components are positioned on one side of the internal support structure and the plumbing components are positioned on another side of the internal support structure.

13. An internal support structure for a spa, the spa including a fluid retaining basin and a seat, the internal support structure comprising:

a first support member, including two legs;

a second support member, including two legs;

at least one cross member coupled to each support member and configured to maintain the support members in a spaced apart relationship, wherein each support member defines a space between the legs;

a first shroud panel removably coupled to the first support member, with at least a portion of the first shroud configured to extend through the plane defined by the legs of the first support member; and a second shroud panel removably coupled to the second support member, with at least a portion of the second shroud configured to extend through the plane defined by the legs of the second support member and with each of the shroud panels configured to meet each other proximate each of the front end and rear end of each of the support members, wherein the first and second shroud panels enclose a portion of each of the support members and wherein an upper edge of the front of each shroud is proximate the basin and a lower edge of the front of each shroud slopes inward toward the center of the apparatus and downward defining a region below a portion of the fluid retaining basin.

14. The internal support structure of claim 13, including a third shroud panel, with the third panel coupled to the first and second shroud panels.

15. The internal support structure of claim 13, wherein the first and second shroud panels each define an arched channel proximate a lower edge of each panel.

16. The internal support structure of claim 13, wherein each of the first and second support members is configured in an arch and maintained in a spaced apart relationship by a plurality of cross-members, each arched support member defining two legs, with each leg including an adjustable foot pad.

17. The internal support structure of claim 16, wherein the first and second arched members are each configured to engage and support the respective first and second shroud panels.

18. The internal support structure of claim 16, wherein each arched member is composed of one of a material selected from a group consisting of metal, plastic, and a combination of metal and plastic.

19. The internal support structure of claim 16, wherein the internal support structure is composed of metal.

20. The internal support structure of claim 19, wherein the basin is composed of a material other than metal.

21. The internal support structure of claim 13, wherein the basin is removable from the internal support structure.

22. The internal support structure of claim 13, wherein at least one magnet couples each shroud panel to each internal support structure.

23. The spa of claim 13, including electrical components and plumbing components, wherein the electrical components and plumbing components are supported and secured to the internal support structure.

24. The spa of clam 23, wherein the electrical components are positioned on one side of the internal support structure and the plumbing components are positioned on another side of the internal support structure.

25. A spa apparatus comprising:

an internal support structure having a front end and a rear end wherein the internal support structure comprises a first arched member and a second arched member, each arched member defining two legs, with the first arched member and the second arched member maintained in a spaced apart relationship by a plurality of cross-members, and with the support structure substantially free of cross-members extending in a direction perpendicular to the plurality of cross-members;

a basin removably coupled and supported by the internal support structure proximate the front end, with the basin including a fluid circulation device;

a seat coupled to the internal support structure, intermediate the basin and the rear end of the internal support structure; and a means for enclosing removably coupled to the internal support structure, wherein a portion of the internal support structure is enclosed.

26. The spa of claim 25, each leg includes an adjustable foot pad.

27. The spa of claim 25, wherein the first and second arched members are each configured to engage and support the means for enclosing.

28. The spa of claim 25, wherein each arched member is composed of one of a material selected from a group consisting of metal, plastic, and a combination of metal and plastic.

29. The spa of claim 25, wherein the internal support structure is composed of metal.

30. The spa of claim 29, wherein the basin is composed of a material other than metal.

31. The spa of claim 25, wherein the basin is removable from the internal support structure.

* * * * *